United States Patent [19]

Evrard

[11] 4,095,394

[45] Jun. 20, 1978

[54] APPARATUS FOR AUTOMATICALLY APPLYING FLEXIBLE STRIPS

[76] Inventor: Jacques Edmond Maurice Evrard, 64 rue des Rondeaux, Paris, France

[21] Appl. No.: 737,009

[22] Filed: Oct. 29, 1976

[51] Int. Cl.[2] ..... B65B 13/02

[52] U.S. Cl. ..... 53/198 R; 53/220

[58] Field of Search ..... 53/198 R, 220, 228

[56] References Cited

U.S. PATENT DOCUMENTS

| | | | |
|---|---|---|---|
| 1,068,460 | 7/1913 | Smith | 53/228 X |
| 1,581,347 | 4/1926 | Huguley | 53/228 |
| 3,122,870 | 3/1964 | Stemmler | 53/198 R |
| 3,269,089 | 8/1966 | Heywood | 53/198 R |
| 3,327,453 | 6/1967 | Willbrandt et al. | 53/198 R |

*Primary Examiner*—J. M. Meister

*Attorney, Agent, or Firm*—Stevens, Davis, Miller & Mosher

[57] ABSTRACT

Apparatus for automatically applying flexible strips around objects consists essentially of a guide for the objects, the cross-section of which is substantially equal to that of the objects, means for sequentially introducing at least one object into the guide at one of its ends, means for feeding a flexible strip in front of the said end in synchronism with the arrival of the object and means cooperating with the said guide for folding down the ends of the strip on the rear face of the object.

3 Claims, 12 Drawing Figures

APPARATUS FOR AUTOMATICALLY APPLYING FLEXIBLE STRIPS

FIELD OF THE INVENTION

This invention relates to apparatus for automatically applying flexible strips around objects. It is particularly valuable in the application of flexible strips to rotationally symmetric articles.

BACKGROUND TO THE INVENTION

It is known that wrapping round objects always gives rise to difficult problems as a result of their geometry, taking account of the fact that the wrapping itself is effected starting from an extended plane surface which is most often rectangular. Tying up, or more generally placing a rectangular strip around the perimeter of, an already wrapped product gives rise to problems of the same order.

Heretofore, the tying strips have been placed on by hand. This clearly necessitates a substantial workforce for which the work is of little interest in itself.

OBJECTS OF THE PRESENT INVENTION

It is an object of the present invention to provide a device for automatically placing flexible strips around articles which avoids the above mentioned disadvantages.

BRIEF STATEMENT OF THE PRESENT INVENTION

According to the present invention there is provided apparatus for automatically placing flexible strips around objects which is characterised in that it comprises a guide for the objects the section of which is substantially equal to that of the product to be covered by the strip, means for feeding a strip in front of one of the ends of the said guide, means for feeding in front of the said strip at least one object, and means allowing the object to penetrate the interior of the guide with entrainment of the strip by one of its faces, and means allowing the application of the ends of the said strip against the opposite face thereof.

The product surrounded by its strip emerges from the other end of the guide. Naturally the strip is presented below the guide in such a fashion that its central part is coincident with the axis of symmetry of the product which is likewise the axis of symmetry of the guide in the case of a rotationally symmetric product. It is also possible to place a strip around two or more objects using apparatus according to the present invention which permits the grouping of objects together.

DETAILED DESCRIPTION OF THE DRAWINGS

Figure 2:
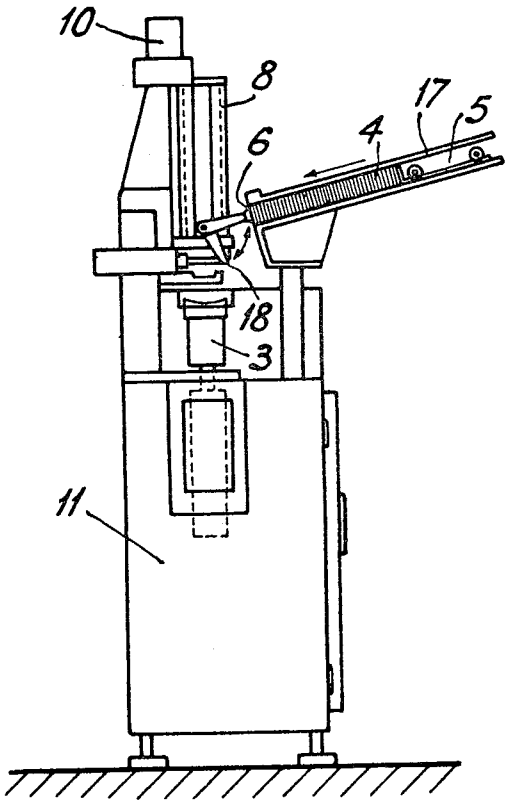
Figure 1:
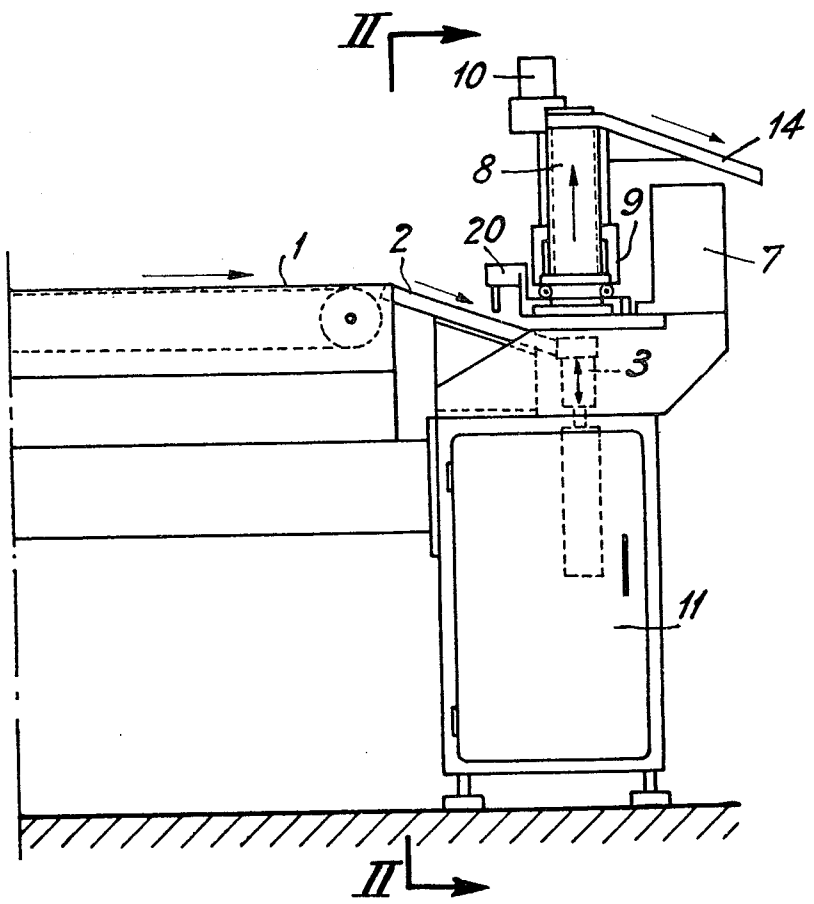
Figure 5:
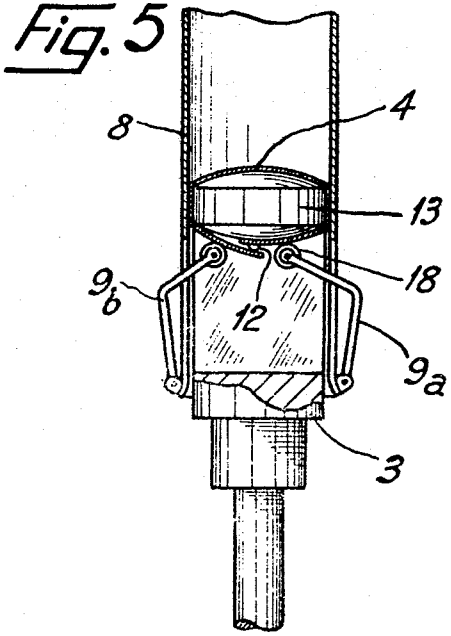
Figure 4:
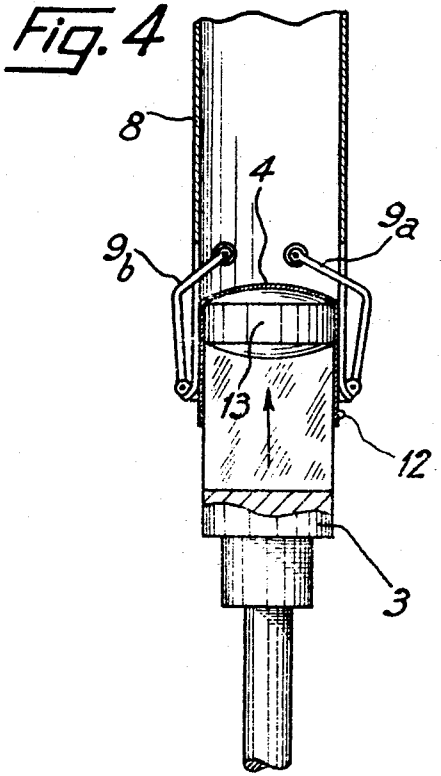
Figure 3:
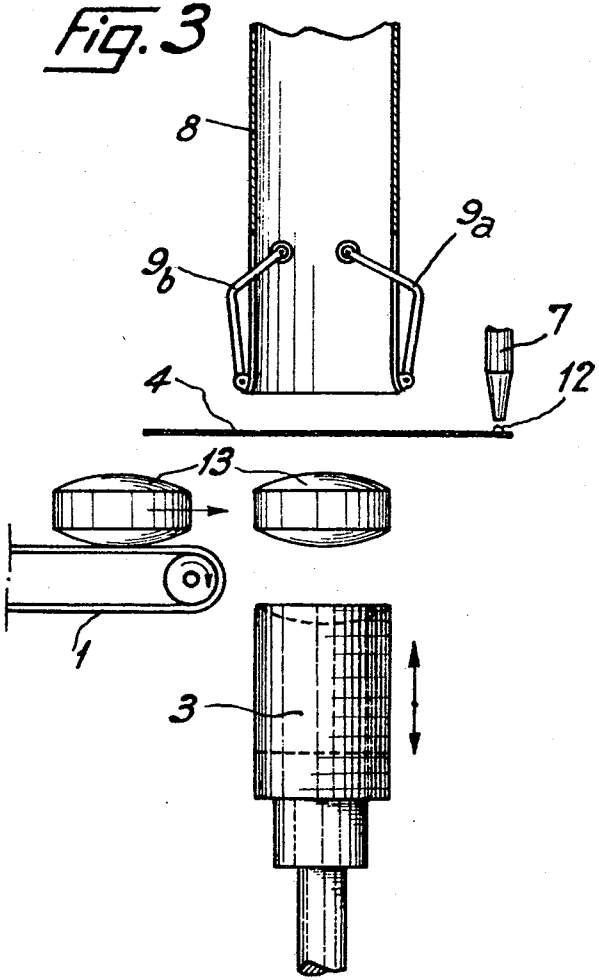
Figure 8:
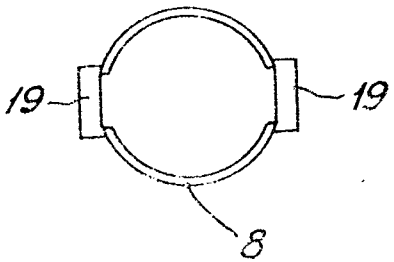
Figure 7:
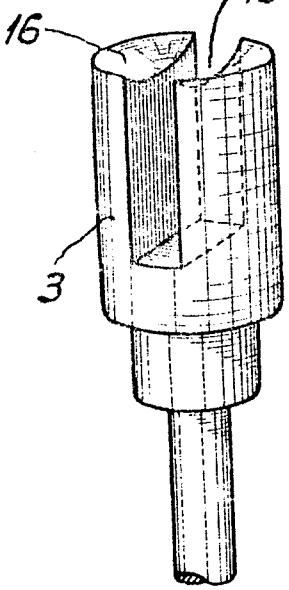
Figure 6:
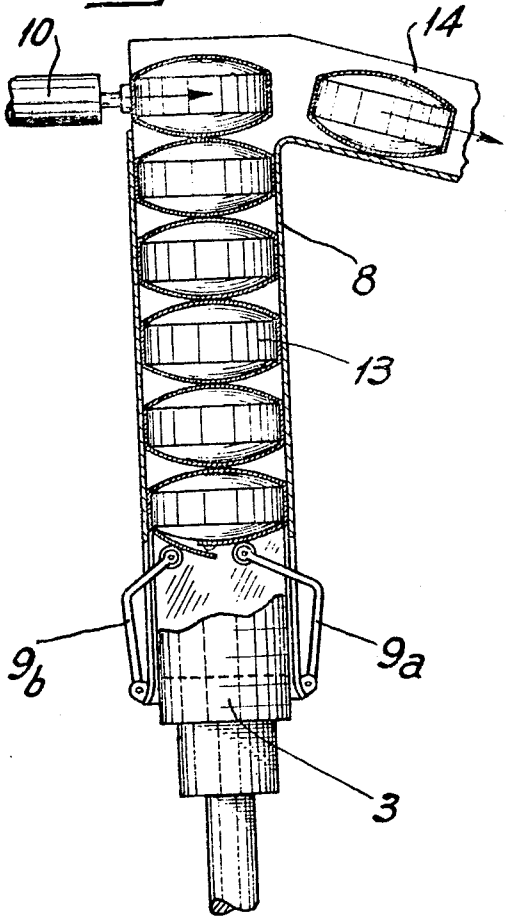
Figures 9, 10, 11, 12:
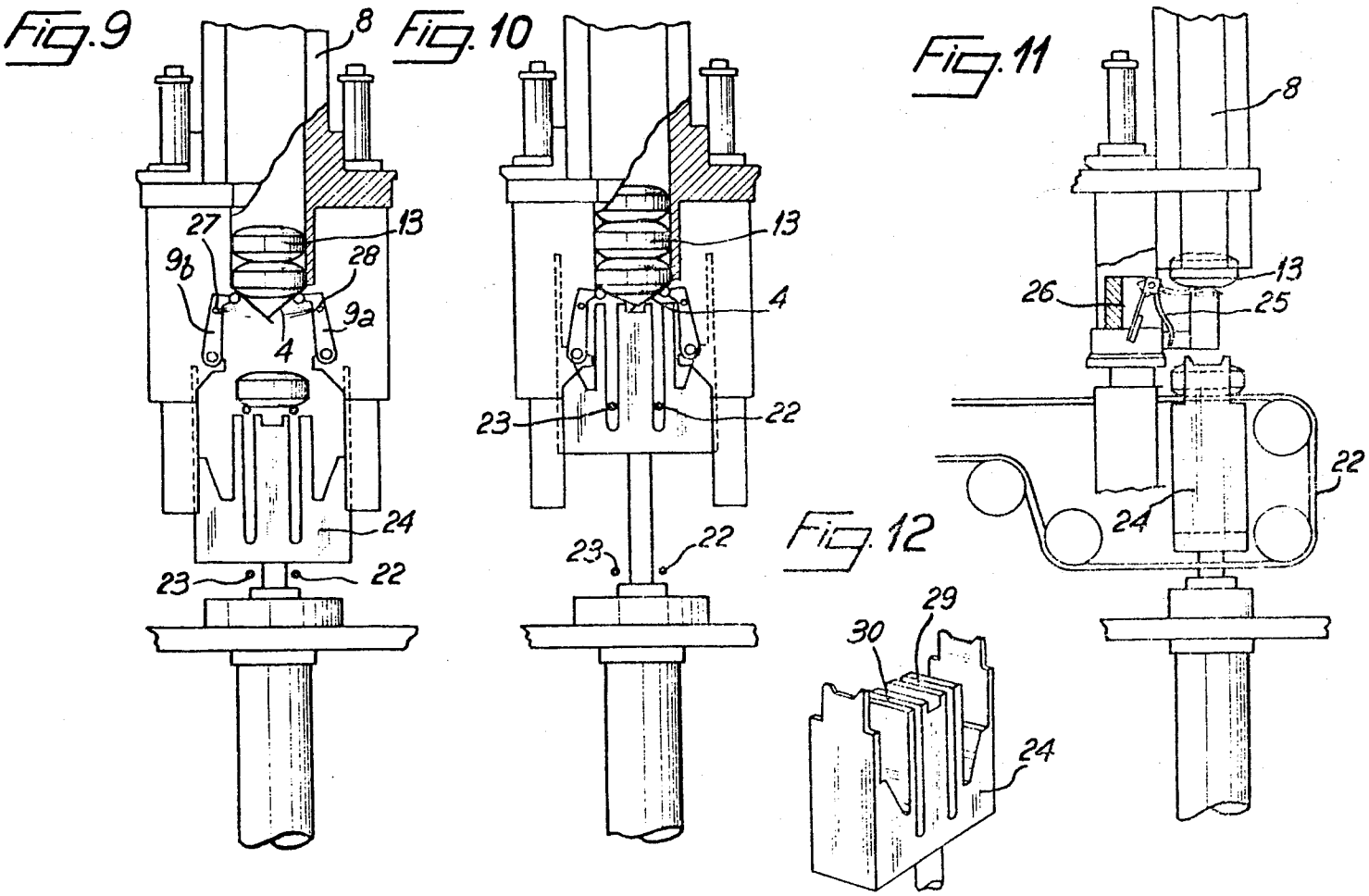

Further characteristics and advantages of the invention will be apparent from the following description taken in conjunction with the accompanying drawings which show various ways in which the invention may be put into effect. In the drawings:

FIG. 1 is a view of apparatus according to the invention and associated devices for feeding objects to and from the apparatus, FIG. 2 is a section along lines II—II of FIG. 1, FIG. 3 is a schematic view of certain parts of the apparatus at the beginning of the operation of applying a strip, FIG. 4 shows the next stage following the rolling of the strip around the object, FIG. 5 shows the final encircling step, FIG. 6 is a sectional view of the guide and objects in the interior thereof, FIG. 7 is a view of the piston serving to introduce the objects into the guide, FIG. 8 is a section of a particular type of object guide, FIG. 9 is a view partly in section of the working parts of an alternative embodiment, FIG. 10 is a view similar to FIG. 9 but of the apparatus at a different stage in its operational cycle, FIG. 11 is a view of the apparatus of FIG. 9 from the direction of the arrow, and FIG. 12 is a perspective view of the article raising piston of the apparatus of FIGS. 9 to 11.

Referring first to FIG. 1 of the drawings, reference numeral 1 denotes generally a conveyor belt which feeds objects to the apparatus as such. This apparatus comprises a base 11 which contains the various mechanical elements serving for controling the movement of a piston 3 and an adhesive applicator 7. At the end of the conveyor belt 1, the objects are fed via an inclined ramp 2 or via a feed conveyor aligned with the lower position of the piston 3, transfer from the belt to the piston being effected by a suction gripper or by a pivoting finger on to the upper part of piston 3. As will appear more clearly from FIG. 2, the strips 4 which are for surrounding the objects are fed simultaneously thereto by a system of suction fingers 6 below a guide 8. The strip 4 is then in horizontal position centred relative to the guide 8. Referring again to FIG. 1, it can be seen that parallel to guide 8 there is located adhesion device 7 which permits a spot of adhesive to be placed on each strip in the case that the strips are not self-adhesive or already provided with an adhesive coating.

Guide 8 has two lateral openings through which extend arms 9 mounted pivotally around two axes located on the frame of the machine and the functioning of which will be described below. At the upper end of guide 8 there is an ejection device 10 which is likewise controlled by means located in base 11 which contains, for example, electro pneumatic control devices. Under the action of the ejection device 10, products surrounded by their strip are pushed onto an outlet ramp 14. On the left hand side of the guide 8 as seen in FIG. 1 there is located a finger 20 which in the particular embodiment which is described here allows it to be avoided that two objects can be placed simultaneously on the piston.

FIG. 2 shows elements which have already been described relative to FIG. 1, but from this figure it is evident how the device is fed by the strips which are destined to surround the objects. These strips are placed in a magazine 17 which consists of an inclined ramp the section of which is equal to the shape of the strips, pressure being exercised thereon by means of a weight 5. The strips are removed from the magazine 17 one after another by the fingers 6 as has been mentioned above and are introduced onto a support 18 which has an opening permitting objects to pass as well as piston 3. The operational mode of the device appears more clearly in the following FIGS. 3, 4 and 5 which show schematically the operation of surrounding an object by a strip.

In the example which is shown on these drawings, the object is a bar of soap 13 which has the general shape of a disc. In FIG. 3, the strip 4 has been introduced in the device and it has been provided by means of the adhesion device 7 which a spot of adhesive 12. An upward movement of the piston 3 permits on one hand the bar of soap 13 to be engaged by the piston and then applied against the strip 4 and the whole assembly of soap 13 and strip 4 is then introduced into the guide 8. As this is shown on FIG. 4, the strip 4 is folded around the object 13 during the introduction thereof into the guide 8. The strip is thus folded down around the object in the form of a inverted U shape. In the next step shown in FIG. 5 the rising movement of the piston 3 has proceeded further and the arms 9*a* and 9*b* which are mounted pivotally on the base having been spread apart under the pressure of the piston have let the object 13 pass. These arms are provided with small rollers or wheels 18 of width that of the strip. Arms 9*a* and 9*b* are biased towards the centre of the guide 8, which in the case shown has the shape of a cylinder, by return springs which are not shown. The shape of arms 9*a* and 9*b* is such that arm 9*a* is biased first towards the centre. The rollers are thus geometrically staggered. It is likewise possible to provide a controlled finger which retains either the arm 9*b* or the paper strip 4 on the side of the arm 9*b*. During this movement the roller 18 rolls on the paper strip 4 and folds down the corresponding end of the strip 4 onto the rear face of the bar of soap 13. The movement of arm 9*a* is then stopped before the roller 18 touches the spot of adhesive 12. A little after the beginning of movement of arm 9*a*, arm 9*b*, under the influence of its return spring, takes up the position which it occupied before the passage of the bar of soap 13. In the same fashion as the arm 9*a*, it applies the other end of the strip by rolling down with roller 18 on the rear face of the bar of soap in such a fashion that the end of the band which is located on the side of arm 9*b* covers up the end of the band which is located on the side of arm 9*a* and adhesion takes place automatically. When the lower face of the object 13 has reached the height of rollers 18, the piston 3 retracts and the bar of soap 13, as well as the bars of soap which have been wrapped round earlier, remain held up on arms 9*a* and 9*b*.

FIG. 7 shows a particular shape of piston 3 which is used in the embodiment which has just been described. The upper surface 16 of the piston is of concave shape corresponding to the shape of the rear face of the bar of soap. A slot 15 is provided on the interior of piston 3 which slot allows the passage of the arms 9*a* and 9*b* on the one hand and assures on the other the centering of the strip 4.

FIG. 6 shows in more detailed fashion the position of the bars of soap 13 in their cylindrical guide 8 at the moment when wrapping round of one bar of soap is finished. The guide 8 contains six bars of soap. It would theoretically be possible to extract the object from the guide after sticking. According to the invention, the bars of soap 13 are superimposed on the latest arrived bar of soap, assuring on the one hand sufficient pressure for adhesion and the sequential functioning of the device permits the adhesive to dry. The piston 3 retracts then as noted above and the bar of soap located at the upper end of the guide is ejected by ejector 10 onto the escape ramp 14 where it pushes the preceding bar of soap. A space is accordingly made in such a fashion as to permit the assembly of bars of soap to be raised during the course of the next movement of the piston.

FIG. 8 is a sectional view of the object guide 8. This section is of generally circular form but has on each side a suitable recess is formed by bars 19 where the cylinder has been cut along axial lines. The recesses so formed are in order to permit the passage of the ends of the strip 4. In effect, when the strip 4 is folded around a bar of soap 13, it only bears thereon along a contact surface which is almost linear while the surface is convex. If no recess were provided, the frictional forces of the bar of soap against the cylinder would be exercised on the angles formed by the strip after folding round and would damage this.

Referring now to FIGS. 9 to 12, elements already described have been denoted with the same reference numerals. In particular the object guide 8 of which the section is substantially that of the cross-section of the objects to be tied up, the two applicator arms 9*a* and 9*b*, and a flexible strip 4 which is to be applied around an object 13 are shown. In this embodiment, the objects 13 are led by a conveyor belt 21 (FIG. 11) which conveyor belt is constituted by two transport straps 22 and 23 which appear in section on FIGS. 9 and 10, these straps being parallel and maintained at a distance such that the objects are suitably supported thereon. In contrast to what happens in the embodiment described above, the conveyor belt 21 passes below the object guide 8 and is crossed by the piston 24, which piston is advantageously of rectangular shape and has two vertical slots 29 and 30 (see FIG. 12) in which slots the straps 22 and 23 are located.

FIG. 9 shows the piston in the lower position and FIG. 10 the piston 24 in the upper position. The objects 13 provided by the conveyor belt 21 arrive when they are exactly below the object guide 8 against an abutment with an electric contact element (not shown) which initiates, for example with the aid of a pneumatic cylinder, the ascending movement of the piston 24. The objects then pass between the articulated arms 9*a* and 9*b* and remain suspended thereon when the piston descends again.

As well as the arms 9*a* and 9*b* there is provided in this embodiment on both sides of the object guide 8 two nozzles 27 and 28 which allow the introduction of two jets of compressed air which has the object of laying down the ends of the strip against the object to be surrounded. The air which penetrates into the object guide 8 is provided from a branch of the apparatus connected with the pneumatic control.

According to a further characteristic of this embodiment, two supplementary arms 25 and 26 allow on the one hand the two ends of the strip to be applied against one another and on the other hand allow a pressure to be applied on these two edges which permits an efficient adhesion of these two edges.

As in the preceding case, this adhesion action is completed by the pressure exercised by the following object 13 at the moment when it penetrates into the object guide 8.

Although the invention has been described with reference to objects in the form of a disc, it is clear that it can be applied when the object has any other shape, for example a rectangular shape, with the condition in each case that the shape of the guide and optionally that of the piston will also be modified. It is accordingly possible for example to tie round a packet of cigarettes with a paper strip. It is likewise possible, without departing from the body of the invention, to assemble on the piston two or several objects which can be connected together with a strip of paper as described above provided that this is sufficiently long. This possibility is particularly interesting in the case of publicity materials. It is likewise possible to assemble with the device according to the present invention objects which are to be sold in pairs, for example the inner soles of shoes.

It is of course to be appreciated that the present invention is in no way limited to the embodiments which have just been described and shown and that numerous variants may be effected, notably by the substitution of equivalent technical means, without departing from the scope of the present invention.

I claim:

1. Apparatus for automatically placing strips around objects comprising a vertical object guide having an open end, the cross section of said guide being substantially equal to the section of the object, means for feeding a flexible strip across the open end of said guide in synchronism with the arrival of an object, a piston to push the object upwardly into said open end so that the flexible strip is folded over one face and the sides of said object by the walls of said guide, and means cooperating with said guide for folding down the ends of the strip on the other face of the object, the upper position of said piston being substantially at the level of said folding down means and the lower position thereof being below the open end at a level lower at least than the height of an object, said piston having an upper surface of a shape complimentary to that of said other face of the object and having grooves centering the strip in the course of its introduction into the guide.

2. Apparatus for automatically placing strips around objects comprising a vertical cylindrical object guide having an open end and diametrically opposite axially extending slots, the cross section of said guide being substantially equal to the section of the object, means for feeding a flexible strip across the open end of said guide in synchronism with the arrival of an object and in a position aligned with said slots, a piston to push the object upwardly into said open end so that the flexible strip is folded over one face and the sides of said object by the walls of said guide, and means cooperating with said guide for folding down the ends of the strip on the other face of the object, the upper position of said piston being substantially at the level of said folding down means and the lower position thereof being below the open end at a level lower at least than the height of an object.

3. Apparatus for automatically placing strips around objects comprising a vertical object guide having an open end, the cross section of said guide being substantially equal to the section of the object, means for feeding a flexible strip across the open end of said guide in synchronism with the arrival of an object, a piston to push the object upwardly into said open end so that the flexible strip is folded over one face and the sides of said object by the walls of said guide, and means cooperating with said guide for folding down the ends of the strip on the other face of the object, the upper position of said piston being substantially at the level of said folding down means and the lower position thereof being below the open end at a level lower at least than the height of an object, and means for introducing objects into the guide including a conveyor belt having at least two rims circulating below the object guide, the piston having as many slots therethrough as the number of conveyor rims and means initiating an upper movement of the piston across the conveyor belt on the arrival of an object.

* * * * *